US012371897B2

(12) United States Patent
Girolmo et al.

(10) Patent No.: US 12,371,897 B2
(45) Date of Patent: Jul. 29, 2025

(54) SELF-STICK BATT

(71) Applicant: JOHNS MANVILLE, Denver, CO (US)

(72) Inventors: Matthew George Girolmo, Lakewood, CO (US); Richard James Clark, Lone Tree, CO (US)

(73) Assignee: Johns Manville, Denver, CO (US)

( * ) Notice: Subject to any disclaimer, the term of this patent is extended or adjusted under 35 U.S.C. 154(b) by 275 days.

(21) Appl. No.: 18/201,414

(22) Filed: May 24, 2023

(65) Prior Publication Data

US 2024/0392558 A1 Nov. 28, 2024

(51) Int. Cl.
*E04B 1/76* (2006.01)

(52) U.S. Cl.
CPC ..... *E04B 1/7662* (2013.01); *E04B 1/7625* (2013.01)

(58) Field of Classification Search
CPC ..... E04B 1/7662; E04B 1/7625; E04B 1/76
See application file for complete search history.

(56) References Cited

U.S. PATENT DOCUMENTS

| | | | | |
|---|---|---|---|---|
| 5,106,447 | A * | 4/1992 | Di Rado | C09J 123/20 525/190 |
| 5,849,131 | A * | 12/1998 | Shaffer | B32B 7/06 156/305 |
| 5,868,891 | A * | 2/1999 | Weir | E04B 1/78 156/184 |
| 6,062,287 | A * | 5/2000 | Ernest | E04B 1/78 156/542 |
| 2020/0298531 | A1 * | 9/2020 | Bertucelli | B32B 27/065 |

* cited by examiner

*Primary Examiner* — Patrick J Maestri
(74) *Attorney, Agent, or Firm* — Robert D. Touslee

(57) ABSTRACT

A method of installing an insulation component in a structural element. The method may comprise providing the insulation component. The insulation component may comprise an insulation layer and a binding layer coupled to the insulation layer. The binding layer may be in a dry state and non-tacky. The method may include applying liquid to the binding layer to activate the binding layer to be in an activated state and tacky, and pressing the binding layer in the activated state against the structural element to install the insulation component in the structural element.

20 Claims, 5 Drawing Sheets

SELF-STICK BATT

BACKGROUND

Insulating a house and/or other structure may include installing insulation components within the walls of the house to minimize heat transfer between the interior of the house and exterior of the house. For example, insulating the attic of a house may include installing batts to an interior surface of the attic. When installing these insulation components, it is important to install these components such that there are no gaps within the installation that allows air to flow between the interior and exterior of the house. However, it may be difficult to install these insulation components without at least some gaps. Accordingly, it is desirable for an improved means and method of securing insulation components to a house while minimizing airflow gaps.

SUMMARY

One aspect of the disclosure provides for a method of installing an insulation component in a structural element. The method may comprise providing the insulation component. The insulation component may comprise an insulation layer and a binding layer coupled to the insulation layer. The binding layer may be in a dry state and non-tacky. The method may include applying liquid to the binding layer to activate the binding layer to be in an activated state and tacky, and pressing the binding layer in the activated state against the structural element to install the insulation component in the structural element. Applying liquid may include applying water to the binding layer. The structural element may be an attic. Applying liquid may include using at least one of a mister to mist the liquid onto the binding layer, a sprayer to spray the liquid onto the binding layer, or a sponge to apply the liquid onto the binding layer. The binding layer may be adherable against the structural element under 10 seconds after applying liquid on the binding layer. Applying liquid may include applying under 0.009 g/in$^2$ of liquid to the binding layer. The method may further comprise, after pressing the binding layer against the structural element, setting the insulation component. The insulation component may be set after being pressed against the structural element after 1-48 hours in 20-60° C. and 10-80% humidity. Providing the insulation component may include providing the insulation component including a release layer coupled to the binding layer and the method may further comprise, before applying liquid to the binding layer, removing the release layer from the binding layer. The release layer may define a perforation along the release layer and the method may further comprise, before removing the release layer, tearing the perforation. The structural element may include rafters defining a cavity therebetween and pressing the binding layer against the structural element may include pressing the insulation component in the cavity. The insulation component may include a width larger than a corresponding width of the cavity such that the insulation component applies a force against the rafters.

Another aspect of the disclosure provides for an insulation component configured to be installed in a structural element. The insulation component may comprise an insulation layer and a binding layer coupled to the insulation layer. In a dry state, the binding layer is non-tacky and, in an activated state, the binding layer is tacky. The insulation layer may include fiberglass. The binding layer in the dry state may include a liquid content between 0.2 wt. % of liquid to 5 wt. % of liquid. The binding layer in the dry state may be non-tacky such that the binding layer includes a coupling force of less than 0.4 pounds-force. The binding layer in the activated state may be tacky such that the binding layer includes a coupling force between 4-10 pounds-force. The binding layer in the activated state may include a liquid content between 55 wt. % to 90 wt. % of liquid. The insulation component may further comprise a release layer coupled to the binding layer such that the binding layer is positioned between the insulation layer and the binding layer.

Yet another aspect of the disclosure provides for a batt. The batt may comprise an insulation layer and a binding layer coupled to the insulation layer. The binding layer may be dry and non-tacky, and the binding layer may be configured to be tacky upon an application of liquid. The batt may include a release layer coupled to the binding layer such that the binding layer is between the insulation layer and the binding layer.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION

Insulation components may be installed in any structure (e.g., a house, vehicle, or the like). The insulation component may be installed in a structural element of that structure, such as a wall, ceiling, roof, attic, of the like. Even further, the insulation component may be installed in a cavity defined within the structural element. For example, installing insulation components in a home may include installing batts in cavities defined between rafters along an interior surface of the attic (or other cavities, such as a wall, ceiling, roof, or the like). Batts, such as fiberglass batts, may provide strong thermal insulative qualities when properly secured within the cavities such that there are no gaps between the rafters of the attic and the batts for air to flow through. As such, installing batts to an attic requires that the batts be precisely measured, cut, and positioned between the rafters of the attic.

However, where the batts are secured through mechanical components, it may be difficult to secure the batts to the room without unintentionally creating gaps during installation. For example, after the batts are positioned within the cavities of the attic, the batts may be secured within the attic cavities by stapling wires (e.g., bailing wire) or bands to the rafters while those wires or bands compress the batt within the cavities. During this installation, the batts may be unintentionally misaligned after being positioned within the cavity and before being compressed by the mechanical components. Such misalignment may lead to gaps between the batts and the rafters, or between adjacent batts. If the batts are secured to the attic in this misaligned position, these gaps may negatively affect the thermal insulation of the attic.

The present disclosure addresses this issue by providing an adhesive to a surface of the batt before installing the batt to the attic. Such an adhesive may be a liquid-activated adhesive so that, during installation, liquid (such as water) may be applied to the adhesive before positioning and pressing the batt to the attic. Through the use of this adhesive, the batt may be adhered to the attic after pressing the adhesive surface of the matt into the cavity, without any further steps, thus minimizing the complexity of batt installation and minimizing the risk of the batt being misaligned when positioned in the cavity.

I. Exemplary Insulation Components

Figure 1:
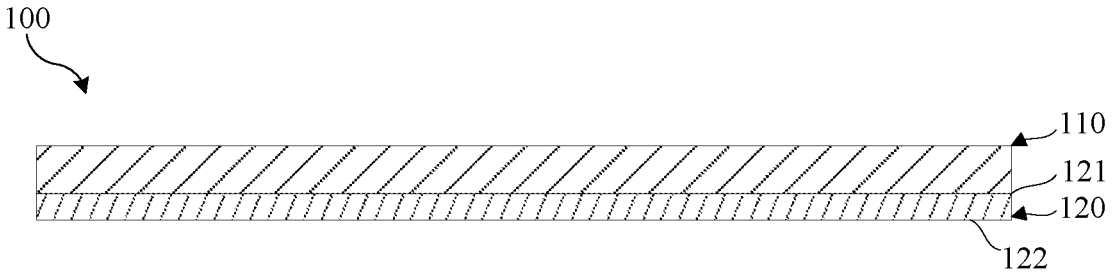
FIG. 1 depicts a cross-sectional view of an insulation component, according to some embodiments.

FIG. 1 depicts an exemplary insulation component 100 in a dry state. The insulation component 100 includes an insulation layer 110 and a binding layer 120. The insulation layer 110 may thermally insulate a structure upon which the insulation component 100 is installed. For example, the insulation component 100 may be a batt installed in a cavity of an attic to provide thermal insulation or the like.

The insulation layer 110 may include a material that provides one or more of the insulative qualities listed above. For example, the insulation layer 110 may include fiberglass based materials made of an inorganic material, such as woven or non-woven fibers adhered together with a binding element (e.g., a thermosetting binder or resin). The fibers may include one or more fibers such as glass fibers, carbon fibers, mineral fibers, stone wool fibers, organic polymer fibers, among other kinds for fibers. In embodiments, the fibers may make up about 50 wt. % to about 99.5 wt. % of the fiberglass-containing products. Additional exemplary fiber weight ranges include about 90 wt. % to about 99 wt. %; and about 75 wt. % to about 95 wt %.

This binding element may be a cohesive or an adhesive binder. The adhesive may be a hot melt adhesive that includes include between about 50% and 90% of a 100% cured acrylic high molecular weight hot melt adhesive with 0% to 20% rosin or terpene resin tackifier and 0% to 15% of curatives. The molecular weight of the resin may range be between about 100,000 MV/g/mol and 600,000 MV/g/mol. In some embodiments, the adhesive may be a pressure sensitive adhesive that includes 50% to 75% styrene butadiene rubber, between 0% and 20% neoprene, between 5% and 15% of a tackifier, and between 0% and 15% of curatives. Where the adhesive is a UV curable adhesive, such as a UV curable acrylic adhesive, the adhesive may be fully cured during manufacturing and/or may be partially cured. In embodiments in which the UV curable adhesive is only partially cured, the UV curable adhesive may be fully cured after installation by exposure to a UV light source, such as a UV lamp and/or natural UV light (sunlight). The UV curable adhesive may include between about may include between about 45% and 80% of a UV cross-linkable acrylic resin, between about 20% and 40% of a tackifier resin, and between about 0% and 15% of a photo-initiator and/or polymerizer.

The binding element may include an effective amount of a water repellant to limit the intrusion of aqueous matter after the binding element is set. For example, vinyl acrylate latex copolymers may further incorporate stearylated melamine for improvement in water repellency. Exemplary concentrations of the stearylated melamine may include about 3 wt. % to 10 wt. %, (e.g., about 6 wt. %). The stearylated melamine may be in liquid form having a solids content of about 40 wt. percent and is mixed with a suitable copolymer latex and water to prepare the binding element. In other embodiments, the binding element may include a silicone material (e.g., reactive silicone) to improve its water repellency. This material mixture may have a pH of about 9, a viscosity of about 45 centipoises and be anionic.

The binder may be a cohesive binder. Examples of a cohesive binder may include, for example, formaldehyde-containing binder compositions. Such compositions may include phenol-formaldehyde (PF) binder compositions, phenol-urea-formaldehyde (PUF) binder compositions, urea-formaldehyde (UF) binder compositions, and melamine-formaldehyde (MF) binder compositions, among other formaldehyde-containing binder compositions. For example, the binder may be a urea formaldehyde composition including between about 50-90% resin, 0-20% urea, and 0-30% other additives. In embodiments, PF binder compositions may include resole binder compositions where the amount of formaldehyde (by mole) exceeds the amount of phenol. Phenol-to-formaldehyde mole ratios in these resole binder compositions range from 1:1 to 1:5 (e.g., 1:1.2 to 1:4.5; 1:1.5 to 1:2.5; etc.). In further embodiments, the PF binder compositions are aqueous compositions characterized by a total solids concentration greater than or about 30 wt. %, greater than or about 40 wt. %, greater than or about 50 wt. %, greater than or about 60 wt. %, or more.

In other embodiments, the insulation layer 110 may include polymer or polymeric materials, such as fibers or membranes. For example, the insulation layer 110 may include high-density polymer or predominantly polymer materials, such as: a high-density polyisocyanurate, polyurethane, polystyrene, or phenolic material or a high-density material made of a blend of these materials; a high-density polyisocyanurate, polyurethane, polystyrene, or phenolic foam material or a high-density foam material made of a blend of these materials; a high-density predominantly polyisocyanurate, polyurethane, polystyrene, or phenolic material with inorganic filler(s) or a high-density material made of a blend of these materials with filler(s); a high-density predominantly polyisocyanurate, polyurethane, polystyrene, or phenolic foam material with inorganic filler (s) or a high-density foam material made of a blend of these materials with filler(s), a high-density material made of other thermoset matrix polymers; or the like. Where the insulation layer 110 includes a polymer material, the insulation layer 110 may contain various powdered and liquid fillers, fiber reinforcements, fungi growth-inhibiting agents, and fire-retardants to reduce the cost of and/or modify the properties of the insulation layer 110. Examples of fillers may include limestone ($CaCO_3$), fiberglass, recycled polyisocyanurate dust, and extenders/plasticizers.

In other embodiments, the insulation layer 110 may include polymeric membranes formed of various synthetic rubber materials, modified bitumen, or thermoplastic materials. For example, insulation layer 110 may commonly include thermoplastic polyolefin (TPO), polyvinyl chloride (PVC), ethylene propylene diene monomer (EPDM), chlorinated polyethylene (CPA), and/or modified bitumen, although some embodiments may use other thermoset and/or thermoplastic membranes. In some embodiments, the polymeric membrane may include one or more polymers blended with one or more fillers. For example, in some embodiments the polymeric membranes may include some combination of the following materials: polypropylene, polyethylene, block copolymer polypropylene, rubber, plasticizers, fiberglass, carbon fiber, fire retardants, and the like. In another embodiment, a polymeric membrane may have a purer polymer blend without or with very few fillers. For example, the polymeric membrane may include mainly polypropylene or polyethylene or some combination of these polymers with little to no fillers, although in some embodiments, these polymeric membranes may include some amount of a filler, such as a fire retardant.

The binding layer 120 may include an insulation surface 121 coupling the binding layer 120 to the insulation layer 110 and a binding surface 122 configured to couple the binding layer 120 to a structure (e.g., an attic). In this manner, once the insulation component 100 is installed, the binding layer 120 may secure the insulation component 100 to the structure (e.g., within an attic cavity) such that the binding layer 120 forms an inner layer of the insulation component 100. The binding layer 120 may be a continuous coating that is substantially coextensive with the insulation layer 110. However, in other embodiments, the binding layer may include binding material discontinuously placed (e.g., a series of lines, dots, or other geometric shapes) along the insulation layer.

The binding layer 120 may include one or more binding elements. For example, the binding element may include an adhesive. One example of such an adhesive may include polymer adhesives, such as acrylic acid adhesives or cold polymers. An example of acrylic acid adhesives is poly vinyl alcohol. Other types of binders may include polyvinyl acetates, ethylene vinyl acetates, urea and triethanolamine, or the like. Other example binding elements may be described in: U.S. patent application Ser. No. 11/075,201 entitled "Fiberglass Binder Utilizing a Curable Acrylate and/or Methacrylate," issued as U.S. Pat. Nos. 7,321,010; 9,180,645 entitled "Self-Stick Insulation and Methods" (the "'645" Patent); U.S. patent application Ser. No. 17/324,232 entitled "Double Pass Process of Making a Self Adhering Roofing Membrane with Improved Adhesion at Lower Installation Temperature," each of which are incorporated by reference herein in their entirety.

Although the binding layer 120 is depicted as being on only one surface of the insulation component 100, in other embodiments, the binding layer may be applied on multiple surfaces of the insulation component. For example, one or more of the lateral surfaces of the insulation component may also include a binding layer.

The binding layer 120 may be liquid-activated such that an application of liquid, such as water, (e.g., through misting, a mop, sponge, power wash tool, or the like) to the binding layer 120 may activate the portions of the binding layer 120 to be tacky. The binding layer 120 may be provided in a dry state. In particular, the binding layer 120 may have between about 5% by weight of liquid to 0.2 wt. % of liquid. In some embodiments, the binding layer 120 may have between about 0.5 wt. % to 4.5 wt. % of liquid, between about 1.5 wt. % to 3.5 wt. % of liquid, and between about 2.5 wt. % to 3.5 wt. % of liquid. In this dry state, the binding layer 120 may have sufficient liquid content such that the binding layer 120 remains coupled (e.g., adhered) to the other portions of the insulation component 100 that the binding layer 120 was already in contact with prior to drying (e.g., during the manufacturing process), such as the insulation layer 110, but does not have enough moisture for the binding surface 122 to be tacky to other structures that were not in contact with the binding layer 120 prior to drying. As such, the binding layer 120 may have a pulpy tactile sensation but may not be a powder. The binding surface 122 may be dry and non-tacky such that there is substantially no material transfer to a structure contacting the binding layer 120 from the binding layer 120. Specifically, the binding surface 122 may be non-tacky where the binding surface 122 has a coupling force (e.g., an adhesion force) to a structure coming in contact with the binding surface 122 of less than 0.4 pounds-force. In some embodiments, the binding surface 122 in a dry state would provide between about 0.05-0.35 pounds-force, 0.1-0.3 pounds-force, 0.15-0.25 pounds-force, or about 0.2 pounds-force to a structure coming in contact with the binding surface 122.

Although the binding layer 120 is reactivated upon the application of liquid, the binding layer 120 may remain in a nonadherable or nonbondable state even when subjected to high humidity and high heat condition. For example, the binding layer 120 may remain in the nonadherable or nonbondable state even when subjected to a relative humidity as high as 90% or more and a temperature of 100 degrees fahrenheit or more. As such, the insulation product may be shipped to and installed in areas of high heat and humidity without negatively affecting the insulation product's performance.

The dry state of the insulation component 100 may provide benefits over other insulation components with high liquid content binding layers. For example, the binding layer 120 may have a decreased weight relative to high liquid content binding layers (and, therefore, other high liquid content insulation components). This decrease in weight may assist in decreasing transportation costs. The binding layer 120 may be more dense than high liquid content binding layers, thus decreasing the overall weight and thickness of the insulation component 100 relative to high liquid content insulation components and allowing more insulation components 100 to be transported within a given space. Further, the binding layer 120 may have sufficiently low liquid content that freezing the binding layer 120 (e.g., during the transportation and application of the insulation component 100 in cold weather) may not affect the tackiness of the binding layer 120 when activated at a later time, as discussed further below, compared to high liquid content insulation components.

The binding layer 120 may have a thickness corresponding to a desired time it takes to activate the binding layer 120 after application of liquid and a desired tackiness (e.g., based on what material the corresponding structure is). For example, a thicker binding layer may provide a greater coupling force to a corresponding structure than a thinner binding layer but may require a longer time and/or more liquid to activate. As such, the thickness of the binding layer 120 may be controlled to correspond to a desired time to activate the binding layer 120. For example, the binding layer 120 may have a thickness such that the binding layer 120 is instantly activated upon being misted by a mist of liquid.

The insulation component 100, and layers 110, 120, may be sized and shaped to couple with other structures. For example, the insulation component 100 may include a length and width sufficient to be positioned within an attic cavity of a home. The insulation component 100 may include a total thickness of 10.25 inches (e.g., for use as a batt in an attic). In some embodiments, the insulation component 100 may include a total thickness of between about In some embodiments, the insulation layer 110 may include a thickness between about 0.75-13.5 inches, 5-12 inches, 7-11 inches, or about 10.25 inches.

In some embodiments, the insulation component 100 may be sized to fit within a standard cavity within an attic. For example, the insulation component 100 may be about 24 inches in width and 48 inches in length. In other embodiments, the insulation component 100 may be about 96 inches in length. However, in yet other embodiments, the insulation component 100 may be greater or less than these dimensions.

The insulation component 100 may include around 3 grams per square foot of binding layer 120 on the insulation layer 110. In other embodiments, there may be between about 1-5 g/ft$^2$ or between about 2-4 g/ft$^2$. In some embodiments, the binding layer 120 may be added to the insulation component 100 so that the dry binding layer 120 layer, film, or coating comprise between 2% and 8% by weight of the insulation component 100. In other embodiments, the dry binding layer 120 layer, film, or coating may comprise between 3% and 6%, between 3% and 4%, and the like by weight of the insulation component 100.

Figure 2:
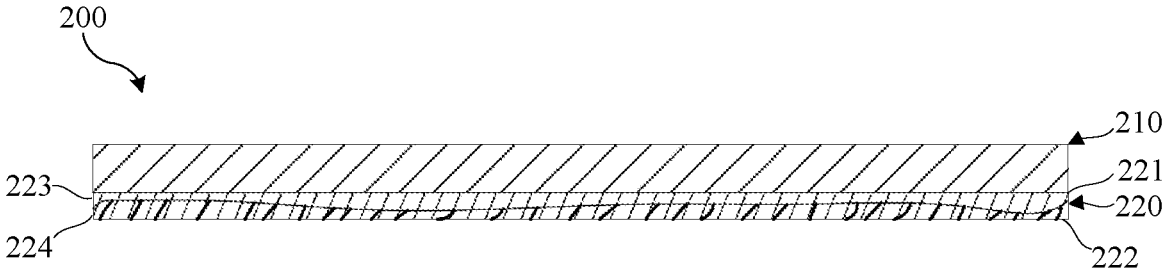
FIG. 2 depicts a cross-sectional view of an insulation component, according to some embodiments.

FIG. 2 depicts an exemplary insulation component 200 in an activated state. It is understood that features ending in like reference numerals as features discussed above are similar, except as noted below. The insulation component 200 may be the insulation component 100 after liquid has been applied to the binding layer 120. As such, the binding layer 220 may include a dry portion 223 and an activated portion 224. The dry portion 223 may be a portion of the binding layer 220 in a dry state, as discussed above. The activated portion 224 may be a portion of the binding layer 220 after liquid has been applied to a dry-state binding layer (e.g., the binding layer 120). For example, the binding layer 220 may be a liquid-activated adhesive material and the activated portion 224 may be a portion of the binding layer 220 that has been activated by application of liquid.

The activated portion 224 may be on an outward-facing surface of the binding layer 220 opposite the insulation layer 210. The shape of the activated portion 224 may be dependent on the type and volume of liquid application to the binding layer 220, as discussed below. For example, if the liquid is a mist applied by a mister, the activated portion may be one or more discontinuous portions on the dry layer of the binding layer. However, if sufficient liquid is applied on the binding layer by the mister, the activated portion may also be a large contiguous area of the binding layer. In other embodiments, where the liquid is applied by a mop (e.g., a semi-dry mop) or other contact-applicator (e.g., a sponge, roller, brush, or the like), the activated portion may be a large, contiguous area on the dry portion 223. The activated portion 224 may substantially cover all of the dry portion 223 depending on how much liquid is applied on the binding layer 220. However, in other embodiments, the activated portion may not cover all of the dry portion.

The activated portion 224 may have a coupling force (e.g., an adhesion force) of 3-10 pounds-force to couple the insulation component 200 to an adjacent structure in contact with the binding surface 222. In some embodiments, the binding surface 222 of the activated portion 224 would provide between about 3-9 pounds-force, 5-8 pounds-force, or between about 6-7 pounds-force.

In order for the binding surface 222 to provide tackiness, the binding layer 220 may require sufficient liquid to activate the binding layer 220 but not so much that the binding layer 220 is oversaturated. Too much liquid saturation may dilute the binding element and inhibit the tackiness of the binding layer 220. As such, the binding layer 220 may have a liquid content between about 55 wt. % to 90 wt. % of liquid. In some embodiments, to remain tacky, the binding layer 220 may have between about 60 wt. % to 85 wt. % of liquid, between about 65 wt. % to 75 wt. % of liquid, or between about 67 wt. % to 70 wt. % of liquid.

The ratio of the activated portion 224 to the dry portion 224 as depicted in FIG. 2 is for illustrative purposes only. For example, in some embodiments, the dry-state binding layer may be provided with just enough liquid that the outward-facing surface of the binding layer is activated. For example, a total application (e.g., via misting) of 5-10 g of liquid on a 24 inch by 48 inch insulation component (or 0.0043-0.0086 g/in$^2$) may activate the dry-state binding layer by penetrating the binding layer without oversaturating the binding layer. In other embodiments, there may be 0.001-0.10 g/in$^2$, 0.005-0.05 g/in$^2$, 0.01-0.045 g/in$^2$, or about 0.03 g/in$^2$ application of liquid. In some embodiments, misting may be preferred to apply the liquid evenly along the binding layer while minimizing the risk of oversaturation.

In some embodiments, the binding layer 220 may become sufficiently tacky upon an application of as little as 10% or 20% liquid by weight of the insulation product. In another embodiment, the binding layer 220 may become sufficiently tacky upon an application of liquid between about 10% and 30% by weight of the insulation component 100. This range allows the adhesive to become tacky without becoming overly fluid and/or without saturating the insulation product with liquid and thereby increasing the weight that must be supported by the adhesive.

Turning back to FIG. 1, as the binding surface 122 has such a low tackiness after drying, the insulation component 100 may be packaged without a release layer on top of the binding layer 120 to prevent the binding layer 120 from sticking to other objects, as would be required in a high liquid binding layer. However, in other embodiments, a release layer may still be provided on top of the binding layer to protect the binding layer from contaminants contacting the binding layer and inhibiting the later activation of the binding layer, or where the binding layer is a high liquid content binding layer. Such a release layer may be made of a foil scrim kraft material, however other materials are envisioned.

Figure 3A:
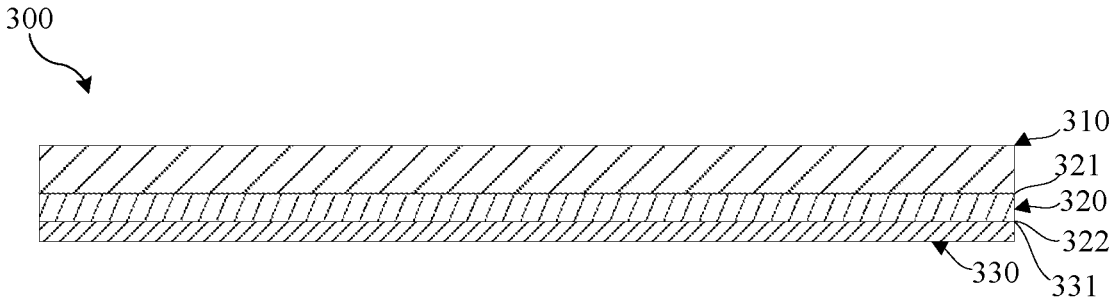
FIG. 3A depicts a cross-sectional view of an insulation component, according to some embodiments.
Figure 3B:
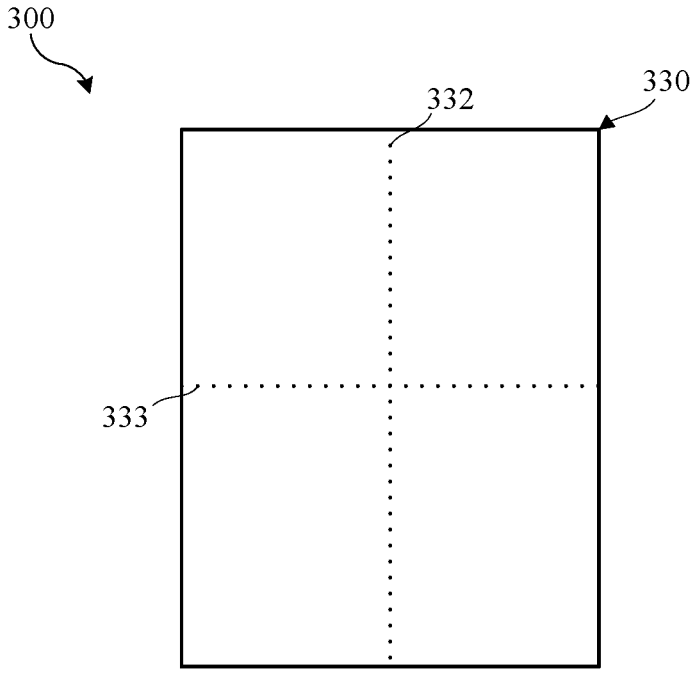
FIG. 3B depicts a top view of a release layer of the insulation component of FIG. 3A.

For example, FIGS. 3A and 3B depict an exemplary insulation component 300. It is understood that features ending in like reference numerals as features discussed above are similar, except as noted below. Turning to FIG. 3A, the insulation component 300 may include a release layer 330 coupled to the binding layer 320 such that the binding surface 322 is not exposed. In this manner, the release layer 330 may protect the binding layer 320 from contaminants contacting the binding layer 320. Further, the release layer 330 may prevent the binding layer 320 from being dried too much such that the binding layer 320 is unable to remain coupled to the insulation layer 310. The binding layer 320 may be provided in a dry state where the binding layer 320 is a liquid-activated adhesive or in an activated state where the binding layer 320 is a high liquid content adhesive that does not require the application of liquid for activation. In other embodiments, there may be release layers on the lateral surfaces of the insulation component where a binding layer is provided on the lateral surfaces of the insulation component.

The release layer 330 may include a release surface 331 coupled to the binding surface 322 of the binding layer 320. The release surface 331 may be treated with silicone or another suitable release agent to allow for the release layer 330 to be easily removable from the binding layer 320. For example, the release layer 330 and the binding layer 320 may be coupled together with a coupling force of less than 0.5 pounds-force. In some embodiments, the release layer 330 and the binding layer 320 may be coupled together with a coupling force of between about 0.05-0.45 pounds-force, 0.1-0.4 pounds-force, 0.15-0.35 pounds-force, or about 0.2 pounds-force to a structure coming in contact with the binding surface 122.

Turning to FIG. 3B, the release layer 330 may include one or more perforation lines 332, 333 defined to extend at least across a portion of the release layer 330. The perforation lines 332, 333 may be a series of dots, slits, or the like defined through the release layer 330. The perforation lines 332, 333 may allow for sections of the release layer 330 to be more easily torn from each other. The perforations may be equal in in size and length or, in other embodiments, unequal. In some embodiments, the perforation lines may be a single cut along the release layer extending across substantially the entire release layer. In other embodiments, the perforation lines are not straight but, rather, curved, angled, or the like. Moreover, in other embodiments, there may be more or less than two perforations lines (e.g., a single horizontal or vertical perforation line). In other some embodiments, the perforation lines may extend the entire length and/or width of the release layer. However, in other embodiments, the perforation lines may extend only a portion of the release layer.

II. Exemplary Manufacturing Methods

Figure 4:
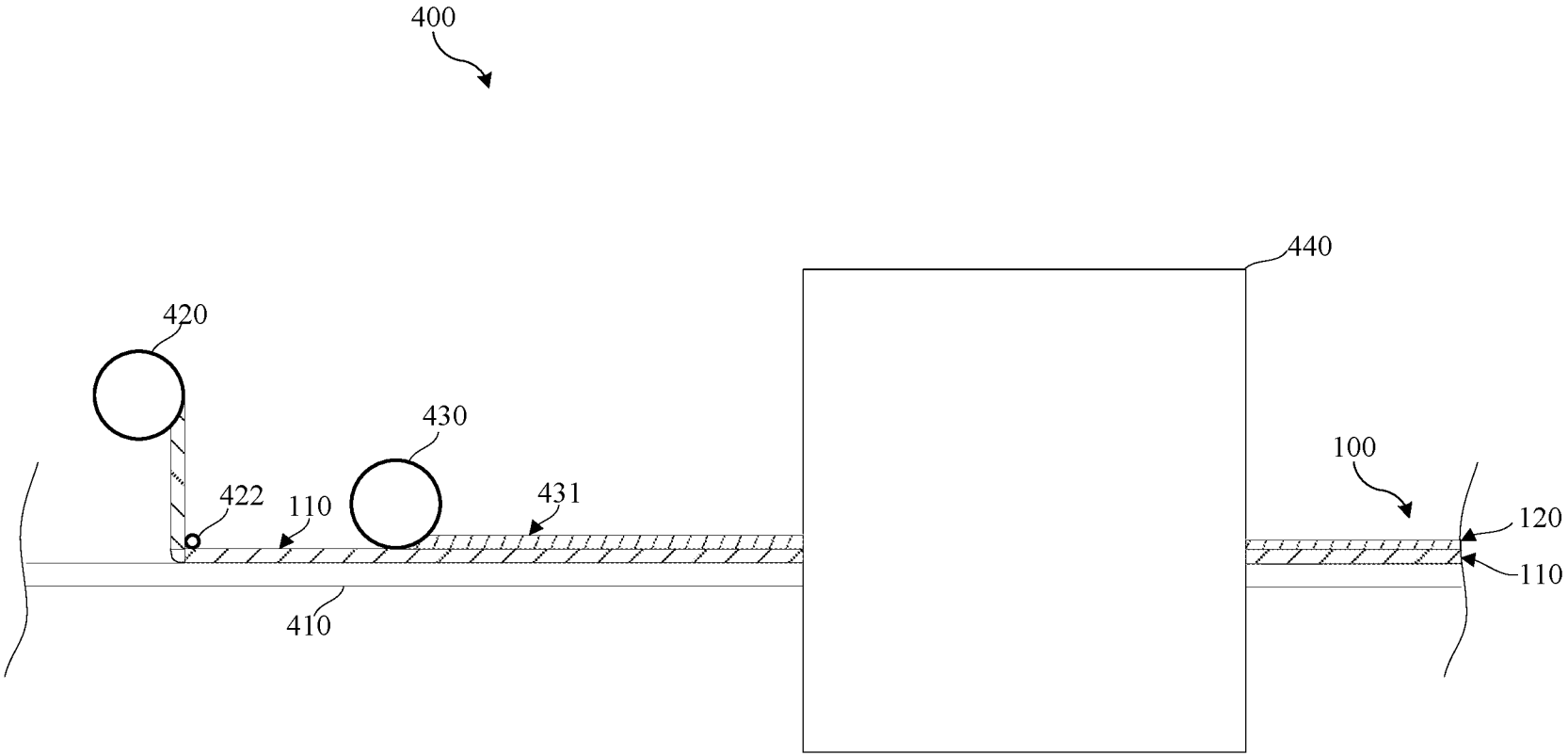
FIG. 4 depicts the formation of the insulation component of FIG. 1, according to some embodiments.

FIG. 4 depicts an exemplary method of manufacturing the insulation component 100. The drying system 400 may include a conveyor belt 410, an insulation roll 420, a roller 422, a binding applicator 430, and a heating chamber 440. The insulation roll 420 may be a roll of insulation layer 110. The roller 422 may be a free-spinning roller for the insulation layer 110 to wrap around as the insulation layer 110 leaves the insulation roll 420 to be positioned on the conveyor belt 410. In this manner, the insulation layer 110 may be pulled out of the insulation roll 420 about the roller 422 and transported along the conveyor belt 410.

The conveyor belt 410 may transport the insulation layer 110 to the binding applicator 430. The binding applicator 430 may couple a binding substrate 431 to the insulation substrate 421. The binding substrate 431 may include one or more binding elements as discussed above. The binding substrate 431 may include a high liquid content such that the binding substrate 431 is still activated when applied on the insulation layer 110. In some embodiments, the binding applicator 430 may be a roller that rolls onto the insulation substrate 421 to deposit the binding substrate 431 as the conveyor belt 410 transports the insulation substrate 421 past the binding applicator 430. However, in other embodiments, the binding applicator may be a sprayer that mists the binding substrate onto the insulation substrate or other means of applying the binding substrate. In some embodiments, there may be additional binding applicators to apply a binding substrate on other surfaces of the insulation layer, such as on the lateral surfaces of the insulation layer.

The binding substrate 431 may include a similar binding material as described above for the binding layer 120 except having a higher liquid content than the binding layer 120. For example, the binding substrate 431 may have greater than 55 wt. % of liquid. In some embodiments, the binding substrate 431 may have between about 60 wt. % to 90 wt. % of liquid, between about 75 wt. % to 85 wt. % of liquid, and between about 70 wt. % to 80 wt. % of liquid. The binding applicator 430 may deposit the binding substrate 431 onto the insulation layer 110 with a certain thickness such that, once the binding substrate 431 is dried (as discussed further below) into a binding layer 120, the binding layer 120 may have a desired thickness corresponding to a desired length of time to activate the binding layer 120.

Once the binding substrate 431 is coupled to the insulation substrate 421, the conveyor belt transports both the insulation substrate 421 and binding substrate 431 through the heating chamber 440 to dry the binding substrate 431 into a dry binding layer 120. The heating chamber 440 may be a convection oven set to a particular temperature (e.g., about 350° F.), and the conveyor belt 610 may be set to a particular speed, to dry the liquid content of the binding substrate 431 to the binding layer 120 in a dry state over a certain period of time. For example, the binding substrate 431 may be dried from 55 wt. % of liquid to 5 wt. % of liquid or less for the binding layer 120. The temperature of the heating chamber 440 and the speed of the conveyor belt 610 may be adjusted based on the liquid content and thickness of the binding substrate 431. In other embodiments, the heating chamber may include infrared heating or other means of heating the binding substrate.

The insulation component 100 is formed once the binding substrate 431 is dried into the binding layer 120. The insulation component 100 may then be packaged for transportation. For example, the insulation component 100 may be rolled into a roll, or the insulation component may be cut into pieces and stacked together for transportation to an end user.

In other embodiments, where the binding layer is provided to the end user as a high liquid content binding layer, there may be no heating chamber. Alternatively, where the insulation layer is provided in an activated state, the heating chamber may be provided to cure the insulation layer. In a further embodiment, the insulation layer may first be cut up prior to the application of the binding substrate and drying the binding substrate to be a binding layer. Greater detail regarding the manufacturing of an insulation component may be found in the '645 Patent.

Figure 5:
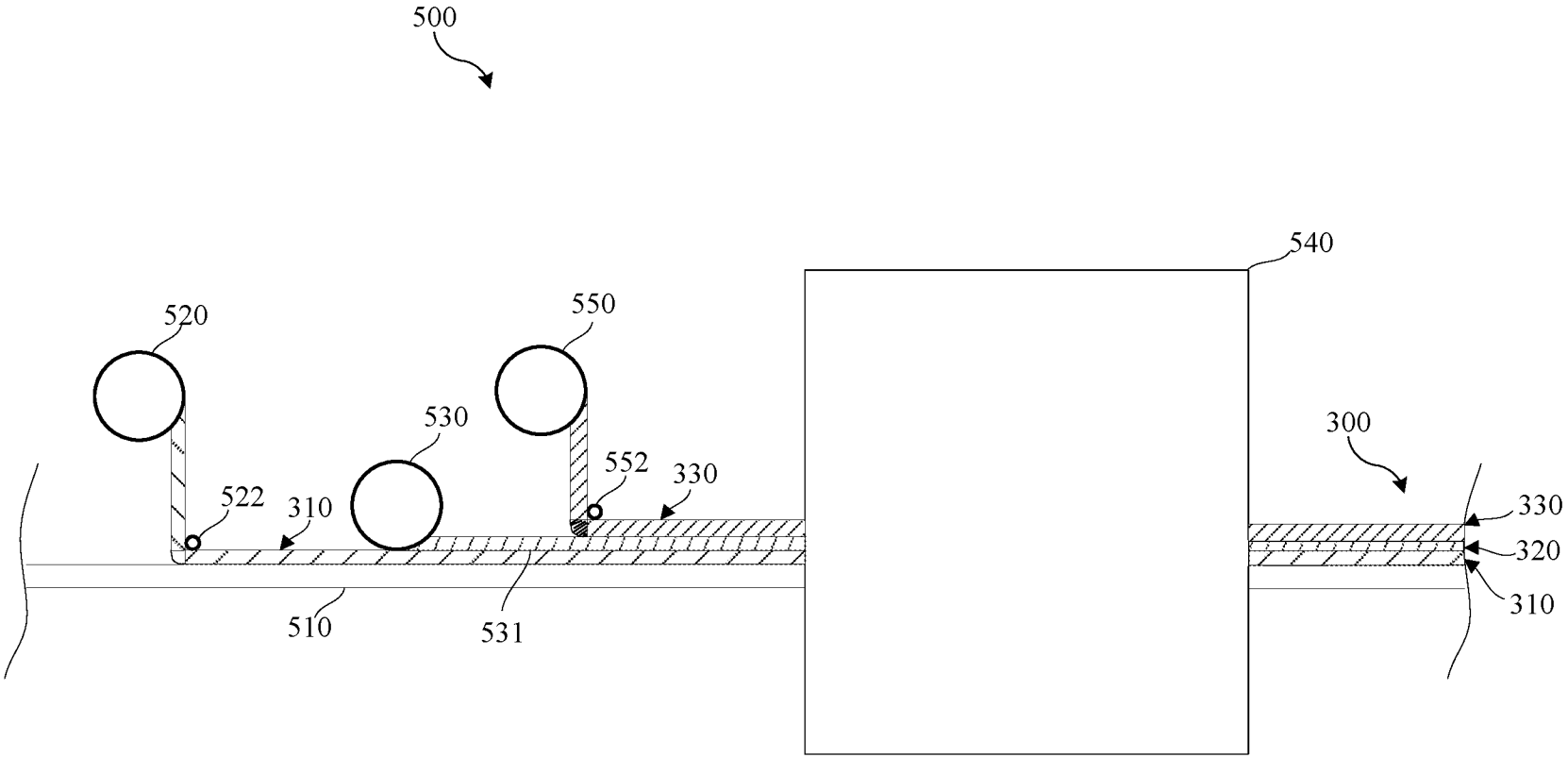
FIG. 5 depicts the formation of the insulation component of FIGS. 3A and 3B, according to some embodiments.

In some embodiments, an insulation component may be manufactured with a release layer (e.g., release layer 330). FIG. 5 depicts an exemplary method of manufacturing the insulation component 300 from an insulation layer 310, release layer 330, and binding substrate 531 using a drying system 500. It is understood that features ending in like reference numerals as features discussed above are similar, except as noted below. Once the binding substrate 531 is applied on the insulation layer 310, the conveyor belt 531 may transport the insulation layer 310 and binding substrate 531 past the roller 552 (similar to the rollers 422, 522) so that the release layer 330 may be applied on the binding substrate 531. In particular, the release layer 330 may be pulled from the release roll 550 and wrapped about the roller 552 to couple to the binding substrate 531. The insulation layer 310, binding substrate 531, and release layer 330 may then be transported by the conveyor belt 510 into the heating chamber 540 to dry the binding substrate 531 into the binding layer 320 and form the insulation component 300. Although FIG. 5 depicts the release layer 330 being applied on the binding substrate 531 before being transported into the heating chamber 540, in other embodiments, the release layer may be applied on the binding layer after the binding substrate has been dried into the binding layer.

Where the release layer 310 includes one or more perforation lines (e.g., perforation lines 332, 333), the perforation lines may act as vents for moisture to release from. In this manner, the steam released from drying the binding substrate 531 may be vented through the perforation lines. In other embodiments, there may be additional release rolls to apply a release layer on the lateral surfaces of the binding substrate where a binding substrate is applied on the lateral surfaces of the insulation layer.

III. Exemplary Method of Use

Figure 6A:
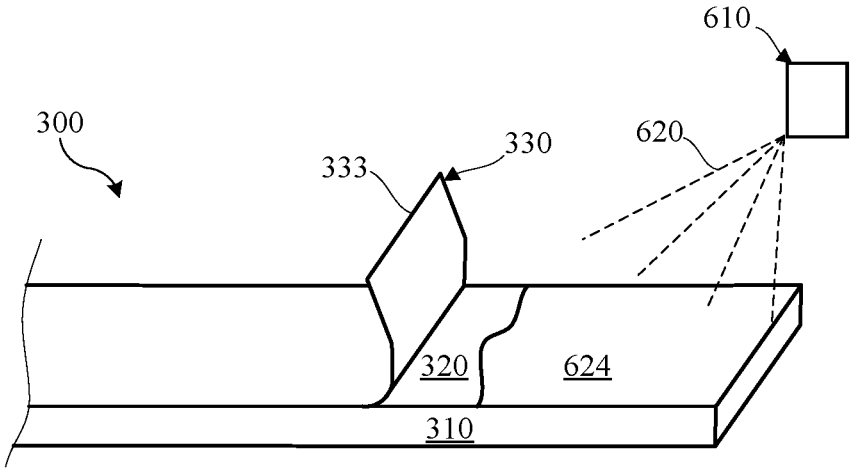
FIGS. 6A and 6B depict the installation of the insulation component on a structure, according to some embodiments.
Figure 6B:
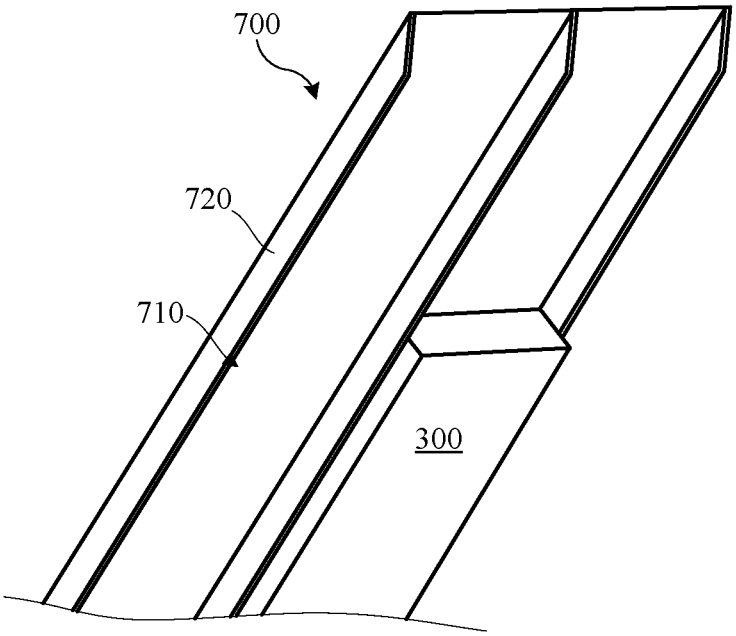

FIGS. 6A and 6B depict a method of installing the insulation component 300 on a structure 700. Once the insulation component 300 has been received by an end user, the end user may unpack the insulation component 300 (e.g., by unrolling a layer of insulation component 300 out of a roll or removing one layer of the insulation component 300 from a stack of insulation components 300) for application to a structure 700 (e.g., an attic).

Once the insulation component 300 has been unpackaged, the insulation component 300 may be laid out, as shown in FIG. 6A, so that the release layer 330 faces outward. At least a portion of the release layer 330 may be peeled back to expose a portion of the binding layer 320. For example, the release layer 330 may be peeled back from the perforated line 333 by tearing along the perforated line 333 and pulling the perforated line 333 away from the binding layer 320. In other embodiments, the release layer may be peeled back from another edge other than the perforated line. In a yet further embodiment, there may be no perforated line and an intermediate section of the release layer may simply be cut to expose an edge to be pulled back. In other embodiments, only a corner may be pulled to expose the binding layer. In a yet further embodiment, multiple corners and edges (e.g., opposite corners and edges) may be pulled backed to expose the binding layer. In a yet further embodiment, there may be no release layer and the insulation component may be installed without peeling back a release layer. In an even further embodiment, a release layer may be pulled off of each lateral surface of the insulation component to expose a corresponding binding layer on the lateral surfaces where the insulation component includes a release layer on each lateral surface.

Once the portion of the binding layer 320 is exposed, liquid may be applied on at least a portion of the exposed surface of the binding layer 320 to activate the binding layer 320 to include an activated portion 624. For example, a liquid applicator 600 may apply liquid 620 onto the binding layer 620. The liquid applicator 600 may include a mister, power wash, mop, hose, or the like. The liquid 620 may be applied on the binding layer 320 in the form of mist, spray, a constant stream, or may be wiped on. The liquid applicator 610 may apply liquid 620 as the release layer 330 is peeled to expose the binding layer 320, prior to all of the release layer 330 being removed. However, in other embodiments, the liquid applicator may apply liquid to the entire portion of the exposed binding layer. In other embodiments, the liquid may be applied on the structure (shown in FIG. 6B) rather than the binding layer. As discussed above, the amount of liquid 320 required to activate the binding layer 320 may correspond to a thickness of the binding layer 320. The liquid applicator 600 may apply liquid 620 along the entire exposed portion of the binding layer 320. Where the insulation component includes a binding layer on each lateral surface of the insulation component, the liquid applicator may apply liquid to each of the binding layers on the lateral surfaces to activate these binding layers.

In some embodiments, the adhesive in the binding layer 320 may include a working or tack time of about 3 minutes or less, 2 minutes or less, about 1 minute or less from the application of liquid and/or after the insulation component 300 is initially installed. In one embodiment, the adhesive's working time may range from between 30 seconds to 1.5 minutes or 30 seconds to 1 minute. The adhesive may quickly form a tacky gel or viscous liquid after liquid is applied. In some embodiments, it may take 15 seconds or less, 10 seconds or less, 5 seconds or less, and the like for the dry adhesive to form the gel or viscous liquid that is re-adherable to other objects. In a specific embodiment, the adhesive may become tacky within 4-8 seconds to the point that the insulation component 300 may be applied to an object's surface and remain in place by transferring a portion of the adhesive to the object's surface. In some embodiments, the adhesive may set up or dry in 30 minutes or less, 20 minutes or less, 15 minutes or less, and the like. Once dried, portions of the adhesive may be in contact with both the insulation component 300 and the object to hold the insulation component 300 to the object. Otherwise, if no portion of the adhesive was transferred to any object (e.g., if the activated adhesive did not come into contact with any object), the adhesive may return to its initial non-tacky state after drying.

Turning to FIG. 6B, once sufficient liquid 620 has been applied to the exposed portion of the binding layer 320 to activate the binding layer 320 (but not enough to oversaturate the binding layer 320, as discussed above) to fully activate activated portion 624, the insulation component 300 may be positioned onto the structure 700. The structure 700 may be an attic defining cavities 710 between rafters 720. The insulation component 300 may be positioned in the cavity 710 with the activated portion 624 facing the structure 700 such that there is no gap between the insulation component 300 and the rafters 720. The insulation component 300 may be pressed against the structure 700 with enough pressure to ensure that all the surfaces of the activated portion 624 contacts the structure 700 (e.g., using a contact-applicator, such as a roller, along a length of the insulation component 300). As the activated portion 624 may be tacky, the insulation component 300 may adhere to the structure 700 within the cavity 710 once the activated portion 624 contacts the structure 700. In some embodiments, the insulation component 300 may simply contact the structure 700 to be adhered to the structure 700.

The activated portion 624 may bind the insulation component 300 to the structure 700 after a period of time, depending on the thickness of the binding layer 320, humidity, and temperature. For example, in some embodiments, the activated portion 624 may set the insulation component 400 to the structure 700 at ambient conditions. For example, the activated portion 624 may set after being positioned in the structure 700 after about 24 hours in 40° C. at 40% humidity. In other embodiments, the activated portion 624 may set after 1-48 hours, 10-38 hours, 15-33 hours, or 20-28 hours. Further, the activated portion 624 may set at 20-60° C., 25-55° C., 30-50° C., or 35-45° C. Even further, the activated portion 624 may set at 10-80% humidity, 30-60% humidity, or 40-50% humidity. The insulation component 300 may be secured to the structure 700 after the insulation component 300 is set to the structure 700. The insulation component 300 may be sized to have a dimension (e.g., a width or length) larger than the cavity 710 such that the sides of the insulation component 300 may apply a force against the rafters 720 to further secure the insulation component 300 within the cavity 710. Further, the insulation component may be shaped to conform to the shape of the cavity where the cavity is non-rectangular (e.g., a hexagonal insulation component for a hexagonal cavity, or the like).

Although the above discussion is directed primarily to installing the insulation component within an attic cavity of a house, the insulation component may be installed in any cavity of any type of building. For example, the building may be a pre-manufactured house and the cavity may be any recess defined within that house.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

What is claimed is:

1. A method of installing an insulation component in a structural element, comprising:

providing the insulation component, comprising:

an insulation layer; and a binding layer coupled to the insulation layer, wherein the binding layer is in a dry state and non-tacky:

applying liquid to the binding layer to activate the binding layer to be in an activated state and tacky; and pressing the binding layer in the activated state against the structural element to install the insulation component in the structural element.

2. The method of claim 1, wherein applying liquid includes applying water to the binding layer.

3. The method of claim 1, wherein the structural element is an attic.

4. The method of claim 1, wherein applying liquid includes using at least one of a mister to mist the liquid onto the binding layer, a sprayer to spray the liquid onto the binding layer, or a sponge to apply the liquid onto the binding layer.

5. The method of claim 1, wherein the binding layer is adherable against the structural element under 10 seconds after applying liquid on the binding layer.

6. The method of claim 1, wherein applying liquid includes applying under 0.009 g/in$^2$ of liquid to the binding layer.

7. The method of claim 1, further comprising, after pressing the binding layer against the structural element, setting the insulation component.

8. The method of claim 7, wherein the insulation component is set after being pressed against the structural element after 1-48 hours in 20-60° C. and 10-80% humidity.

9. The method of claim 1, wherein providing the insulation component includes providing the insulation component including a release layer coupled to the binding layer; and the method further comprises, before applying liquid to the binding layer, removing the release layer from the binding layer.

10. The method of claim 9, wherein the release layer defines a perforation along the release layer; and the method further comprises, before removing the release layer, tearing the perforation.

11. The method of claim 1, wherein:

the structural element includes rafters defining a cavity therebetween; and pressing the binding layer against the structural element includes pressing the insulation component in the cavity.

12. The method of claim 11, wherein the insulation component includes a width larger than a corresponding width of the cavity such that the insulation component applies a force against the rafters.

13. An insulation component configured to be installed in a structural element, comprising:

an insulation layer; and a binding layer coupled to the insulation layer, wherein:

in a dry state, the binding layer is non-tacky; and in an activated state, the binding layer is tacky.

14. The insulation component of claim 13, wherein the insulation layer includes fiberglass.

15. The insulation component of claim 13, wherein the binding layer in the dry state includes a liquid content between 0.2 wt. % of liquid to 5 wt. % of liquid.

16. The insulation component of claim 13, wherein the binding layer in the dry state is non-tacky such that the binding layer includes a coupling force of less than 0.4 pounds-force.

17. The insulation component of claim 13, wherein the binding layer in the activated state is tacky such that the binding layer includes a coupling force between 4-10 pounds-force.

18. The insulation component of claim 13, wherein the binding layer in the activated state includes a liquid content between 55 wt. % to 90 wt. % of liquid.

19. The insulation component of claim 13, further comprising a release layer coupled to the binding layer such that the binding layer is positioned between the insulation layer and the binding layer.

20. A batt, comprising:

an insulation layer;

a binding layer coupled to the insulation layer, wherein:

the binding layer is dry and non-tacky; and the binding layer is configured to be tacky upon an application of liquid; and a release layer coupled to the binding layer such that the binding layer is between the insulation layer and the binding layer.

* * * * *